US010516240B1

(12) United States Patent
Insalaco

(10) Patent No.: US 10,516,240 B1
(45) Date of Patent: Dec. 24, 2019

(54) FUNCTIONAL INDOOR COAXIAL WALL OUTLET COVER

(71) Applicant: Socket Solutions, LLC, Houston, TX (US)

(72) Inventor: Michael George Insalaco, Houston, TX (US)

(73) Assignee: Socket Solutions, LLC, Houston, TX (US)

( * ) Notice: Subject to any disclaimer, the term of this patent is extended or adjusted under 35 U.S.C. 154(b) by 0 days.

(21) Appl. No.: 16/134,832

(22) Filed: Sep. 18, 2018

(51) Int. Cl.
*H01R 13/60* (2006.01)
*H01R 13/74* (2006.01)
*H01R 9/05* (2006.01)

(52) U.S. Cl.
CPC ..... *H01R 13/748* (2013.01); *H01R 9/0503* (2013.01)

(58) Field of Classification Search
CPC .. H01R 13/652; H01R 13/447; H01R 25/006; H01R 23/025; H01R 31/02; H02G 3/14
USPC ..... 439/106, 107, 149, 535, 536, 652; 174/66, 67; 220/241, 242
See application file for complete search history.

(56) References Cited

U.S. PATENT DOCUMENTS 3,714,616 A * 1/1973 Sample ..... H01R 31/02 174/67
4,043,629 A * 8/1977 Brannen ..... H01R 24/525 439/564
4,451,108 A * 5/1984 Skidmore ..... H02G 3/126 439/536
4,797,507 A * 1/1989 Lofving ..... H01R 13/516 174/503
5,002,502 A * 3/1991 Hill ..... H01R 13/74 348/E5.128
5,004,435 A * 4/1991 Jammet ..... H01R 25/006 439/652
5,094,630 A * 3/1992 Jammet ..... H01R 31/02 439/652
5,375,728 A 12/1994 West
5,401,184 A 3/1995 Sundstrom
5,542,852 A 8/1996 Hush
5,723,816 A * 3/1998 Neece ..... H02G 3/14 174/66
6,703,562 B1 3/2004 Pacheco
6,897,381 B2 * 5/2005 He ..... A01M 1/2072 174/66

(Continued)

*Primary Examiner* — Thanh Tam T Le
(74) *Attorney, Agent, or Firm* — Karen B. Tripp

(57) ABSTRACT

An indoor coaxial wall outlet cover permitting functional use of a coaxial wall outlet while fully concealing the coaxial connector plug of the coaxial wall outlet. The cover has a hidden, functional coaxial connector plug that inserts into the coaxial connector plug attached to the underlying coaxial outlet box in the wall and is connected to an extended coaxial cable having at its distal end one or more functional coaxial connector plugs for use of the wall outlet to connect to a wide variety of home entertainment equipment such as televisions, DVRs, CATV, and satellite TV receivers. The cover can be essentially featureless in outward appearance, and when positioned over a wall coaxial outlet box, the cover can fully hide that box. The cover is thin so that furniture may be positioned effectively flush against the wall in front of the covered coaxial outlet box.

17 Claims, 3 Drawing Sheets

(56) References Cited

U.S. PATENT DOCUMENTS

| | | | | |
|---|---|---|---|---|
| 6,977,342 | B1 * | 12/2005 | Maltby | H02G 3/14 174/66 |
| 7,229,322 | B2 * | 6/2007 | Bangert | H01R 25/003 439/13 |
| 7,465,359 | B2 * | 12/2008 | Vives-Martinez | A63F 3/068 134/21 |
| 8,158,885 | B2 * | 4/2012 | Eastin | H02G 3/14 174/66 |
| 8,242,364 | B1 | 8/2012 | Shotey | |
| 8,317,527 | B2 | 11/2012 | Vitale | |
| 8,668,347 | B2 | 3/2014 | Ebeling | |
| 8,834,210 | B2 * | 9/2014 | Brausen | H01R 31/065 439/718 |
| 9,461,419 | B2 * | 10/2016 | Hector, Jr. | H01R 25/003 |
| 9,509,080 | B1 * | 11/2016 | Insalaco | H01R 24/30 |
| 9,525,232 | B1 * | 12/2016 | Insalaco | H01R 13/447 |

* cited by examiner

FUNCTIONAL INDOOR COAXIAL WALL OUTLET COVER

BACKGROUND OF THE INVENTION

1. Field of the Invention

The present invention relates to coaxial connector devices and similar devices primarily for transmission of data such as radio frequency signals and digital data needed for operation of various electronic equipment such as televisions and computers and peripheral devices associated with them. More particularly, the invention relates to indoor outlets for coaxial cables, ethernet cables, universal serial bus cables, high-definition multimedia interface cables, and the like, and indoor outlet covers for such outlets.

2. Description of Relevant Art

Coaxial cable, or coax, is a transmission line that consists of a tube of electrically conducting material surrounding a central conductor held in place by insulators and that is used to transmit telephone, television, and internet signals. The ends of coaxial cables usually terminate with connectors. Coaxial cable assemblies are used extensively to interconnect a wide variety of home entertainment equipment such as televisions (TVs), digital video recorders (DVRs), community antenna television (CATV) and satellite TV receivers. Cable TV and/or cable internet service in buildings, particularly in homes, offices, and schools, are typically provided at least in part through coaxial wall outlets. Modern homes are typically equipped with at least one coaxial cable wall outlet in each room. This is because cable companies primarily use coaxial cables to bring cable television to their customers. Coaxial cables can be connected from the coaxial wall outlet directly to a television, cable box or cable modem or router used to connect one or more users to the internet.

Devices needing radio frequency signals, digital data, or electrical current through a coaxial cable (or ethernet or other LAN cable) for operation or use, typically have coaxial cable female connectors for connection to a male connector of a coaxial cable ending in a coaxial male or female plugs connector attached to a coaxial wall outlet. Once the coaxial cable is attached to the coaxial wall outlet, radio frequency signals or digital data can transmit (or if applicable, electrical current can flow (or does flow if the coaxial wall outlet has electrical current flowing into it) to the coaxial cable for transmission to the device needing the signal, data, or current.

Most typically, when a coaxial cable connector plug with a coaxial cable cord is connected to a coaxial wall outlet, the coaxial cable connector plug and coaxial cable extend several inches from the coaxial wall outlet before the coaxial cable curves to a parallel posture with respect to the wall. As a consequence, furniture or other items positioned adjacent to the wall must be positioned sufficiently away from the coaxial wall outlet to accommodate the coaxial cable connector plug and coaxial cable connection to the coaxial wall outlet. Such positioning wastes space in the room.

Moreover, typically and commonly used coaxial wall outlets are themselves generally unattractive and have their connector plug protrude from the wall posing a potential safety hazard for infants and children. That is, most coaxial wall outlets are installed just above the baseboard within reach of infants and children and as a result cause or result in a risk of injury to infants and children should they fall into or bump into such protruding coaxial cable connection component.

There is presently a need in the art for coaxial wall outlets and coaxial wall outlet covers that overcome the shortcomings presented above.

SUMMARY OF THE INVENTION

The present invention provides an indoor coaxial wall outlet cover that solves the problems currently associated with indoor coaxial wall outlets. The present invention provides an indoor coaxial wall outlet cover that is thin enough to avoid adding bulk to the coaxial wall outlet, thereby enabling furniture to effectively be positioned against the wall or at least as close as the baseboard on the wall, while also effectively eliminating the coaxial cable connection component that protrudes from traditional coaxial wall outlet covers, thereby acting as a safety device for infants and children that are at risk of injury from falling into or bumping into such protruding coaxial cable connection component. Further, the invention affords a convenient and easy way to effectively or functionally move the coaxial wall outlet to a different location in a room without actually having to move the wall outlet itself.

Moreover, the outlet cover is aesthetically pleasing—it is unobtrusive and calls less attention to itself than does the coaxial wall outlet without the cover of the invention. This is because the outlet cover, at least in one embodiment, is essentially or substantially blank, hides the coaxial cable connector completely, and results in only one thin coaxial cable extending from the underlying coaxial outlet box and that extension is in a manner where the coaxial cable lies against the wall or along the wall or less than about one-half inch from the wall, at least when proximate the underlying coaxial outlet box in the wall. In one embodiment, the coaxial cable running along the wall can be affixed to the wall, such as for example with a strong adhesive tape, or with cable clips affixed to the wall with a strong adhesive, to further enhance the child safety aspect of the invention as well as the aesthetic neat and tidy appearance of the invention in use.

The present invention effects these advantages by providing a thin cover, preferably smooth on the outside, that just extends fully over the surface of an underlying coaxial outlet box in the wall having at least one coaxial cable within or attached thereto, without protruding significantly therefrom and that has a coaxial cable female connection component on the backside that attaches or plugs into a coaxial cable male connection component of the underlying coaxial outlet box in the wall. Screws or other connectors, fastened through the front side of the cover to corresponding screw holes or other connector receivers of the underlying coaxial outlet box in the wall, hold the cover in place over the underlying coaxial outlet box in the wall. The coaxial male connection component of the cover of the invention has a coaxial cable attached thereto that extends downward from the coaxial male connection component, out of the cover, and falls generally flush with the wall to the floor, where the coaxial cable lies against the wall or along the wall or less than about one half inch from the wall, at least when proximate the underlying coaxial outlet box in the wall, and then lies along the floor or other desired surface, ending in one or more coaxial male connection components. The coaxial cable female connection component in one embodiment is a size suitable to attach to or plug into the coaxial cable male connection component of the underlying coaxial outlet box in the wall so that the connection of that coaxial cable female connection component does not add bulk or cause the cover to extend significantly beyond the outer surface of the underlying coaxial outlet box in the wall.

BRIEF DESCRIPTION OF THE DRAWINGS

The present invention will be better understood by referring to the following detailed description of preferred embodiments and the drawings referenced therein, in which.

DETAILED DESCRIPTION OF PREFERRED EMBODIMENTS

Figure 2:
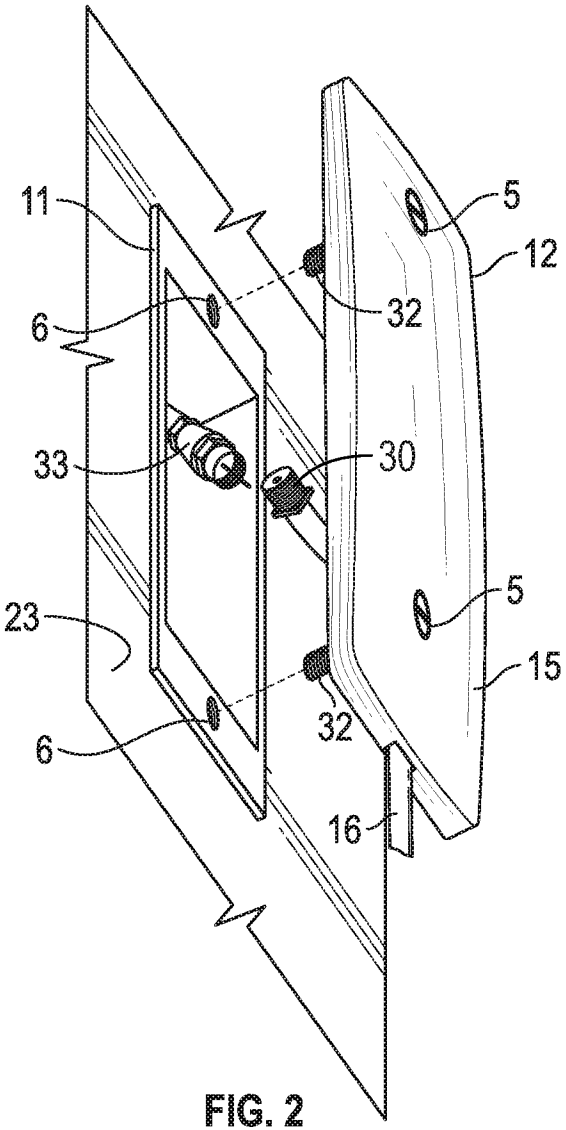
FIG. 2 is an enlarged front side perspective view of the cover of the embodiment of the apparatus of the invention of FIG. 1, just before it is attached to a typical coaxial outlet box in a wall (for illustration and not drawn to scale).
Figure 1:
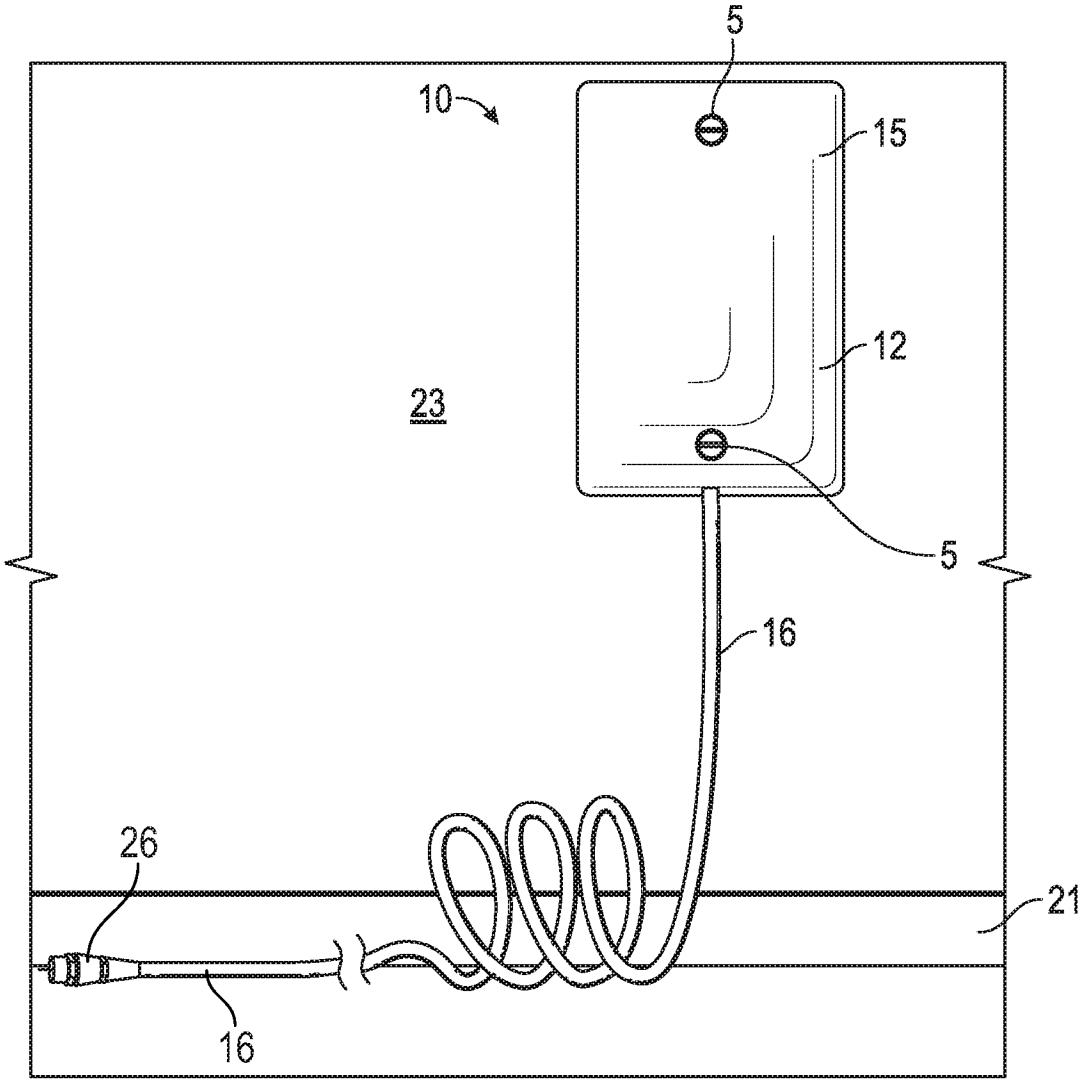
FIG. 1 is a front perspective view (for illustration and not drawn to scale) of one embodiment of the apparatus of the invention, as shown attached to a coaxial outlet box in a wall as it might typically be used.

Referring generally to FIGS. 1 and 2, the present invention provides for the indoor transmission of radio frequency signals, digital data, or electrical current through a coaxial cable by means of an indoor, thin, blank coaxial wall outlet cover 15 in a manner that fully conceals a coaxial cable connection component 30 of a coaxial cable 16 directly connected to a coaxial cable connection component 33 of an underlying coaxial outlet box 11 in a wall 23. That coaxial cable 16 runs from that coaxial cable connection component (30) connected to said coaxial cable connection component 33 of the underlying coaxial outlet box 11 in the wall 23, past, through, or out of the coaxial wall outlet cover 15, preferably at the base of the cover 15, and ends a desired distance away with at least a coaxial cable connection component 26 at the coaxial cable's distal end, as shown in FIG. 1.

This apparatus of the invention is particularly advantageous as a safety device that permits functional use of a typical indoor coaxial outlet box while fully concealing the underlying coaxial outlet box in a wall. The apparatus of the invention obtains such safety advantage while being so thin as to avoid adding any significant bulk to the wall outlet cover, thereby enabling a user to position furniture in front of or adjacent to the outlet and essentially flush with, i.e., less than about one-half inch away from, the wall on which the outlet is located, or at least as close to the wall as any baseboard on the wall permits, and thereby providing another advantage of the invention.

The present invention eliminates the traditional manner of connecting a visible (first) coaxial cable connection component at the end of a coaxial cable to a visible (second) coaxial cable connection component of a coaxial wall outlet in order to receive transmission of signals or data or electrical current through such coaxial wall outlet. Interior coaxial wall outlets are points within a building or a home where radio frequency signals, digital data, or electrical current can be transmitted to televisions (TVs), digital video recorders (DVRs), community antenna television (CATV) and satellite TV receivers. The most common such outlets have a single coaxial cable female connection component protruding from the center of the outlet and are designed to accept a first coaxial cable male connection component at the proximal end of a coaxial cable. The coaxial cable has at its distal end a second coaxial cable male connection component designed to attach to a coaxial cable female connection component of various receivers such as televisions (TVs), digital video recorders (DVRs), community antenna television (CATV) and satellite TV receivers.

The present invention has utility with any coaxial outlet box in a wall having at least one coaxial cable connection component for receiving or connecting thereto a coaxial cable (through the coaxial cable's connection component). The term "typical (or standard) indoor coaxial outlet box" herein is understood to refer to such coaxial outlet boxes as well as similar coaxial outlet boxes that have more than one coaxial cable connection component. Such outlet boxes most commonly have a male connection to the coax within the outlet box and a female adapter connected thereto, as known to one of ordinary skill in the art. The present invention is designed to work with male or female connections, with compatibility between a connector and a coax cable obtained with adapters which are already known and commonly used where the coax connection is male (or female) and the connector is also male (or female) so that an adapter is needed for the standard or typical complete male-female connection (or an adapter for a female-female connection, for another example). For ease and more understandable presentation herein, the coax connection within the outlet box will be understood to be male and the connection component associated with the proximal end of the coax cable connection component of the present invention which extends through the outlet cover of the present invention for connection to the coax in the outlet box will be understood to be female, although as discussed, variations between male and female connectors could as easily be used with the invention, as understood by one or ordinary skill in the art.

Figure 4:
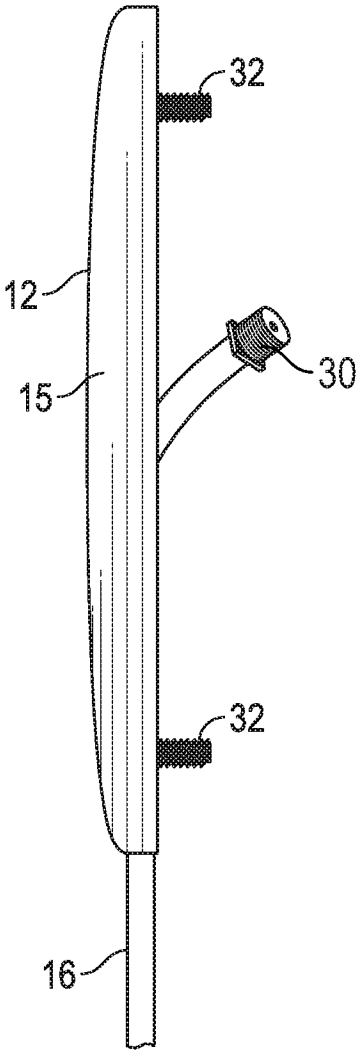
FIG. 4 is a side view of the cover of the embodiment of the apparatus of the invention of FIG. 3 or FIG. 5.

Referring again to FIG. 1, one embodiment of the apparatus 10 of the invention is shown in place over a typical indoor coaxial outlet box 11 (not shown in FIG. 1 but shown in FIG. 2) on an interior wall 23. FIG. 2 shows the cover 15 of apparatus 10 just before attachment to the coaxial outlet box 11 by means of fastening screws 32 through the screw holes 5 of cover 15 of the apparatus 10 to the corresponding screw holes 6 of coaxial outlet box 11. In this embodiment, the usual wall plate that covers the coaxial outlet box is removed or has been removed before positioning cover 15 of apparatus 10 over it. Conveniently, the screw holes 6 in the outlet box 11 that accepted screws 32 to hold the wall plate over the outlet box 11 can instead accept screws 32 to hold cover 15 over the outlet box 11. FIG. 4, showing the side of cover 15, indicates the thin, low profile of cover 15, particularly comprising frontplate component 12 mounted on backplate component 14 (shown in FIG. 3) or an alternative backplate component 144 (shown in FIG. 5) and the coaxial cable female connection component 30 exiting outwardly from about the center of the back of the cover 15. In some embodiments, the coaxial cable female connection component 30 is afforded some flexibility in extending out of the backplate component 14 (or 144) and can be repositioned upward or downward to better accommodate variations in position of the male connection component 33 within the outlet box 11. Such flexibility may be afforded, for nonlimiting example, by not significantly restricting movement of the female connection component 30 at the position where it exits the cover 15. Backplate 144 contributes to affording such flexibility by not extending past roughly half of the area (or more) of the frontplate, and thereby allowing a large open area for maneuvering the female connection component 30.

FIGS. 1 and 2 are drawn to illustrate features of the invention and are not drawn to scale. That is, cover 15 is drawn larger with respect to the remainder of the apparatus 10 and with respect to the coaxial outlet box 11 than is actually contemplated to in fact occur with the embodiments of the invention as will be more fully explained below.

As used herein, the term "frontplate" with respect to the apparatus of the invention and particularly cover 15 means the faceplate or faceplate component of cover 15, and not the common faceplate or wall plate covering the outlet box. The apparatus of the invention is used to conceal the coaxial outlet box 11 but no change or adjustment to coaxial outlet box 11 needs to be made, except as noted above, the common faceplate or wall plate over the outlet box (with a coax connector therein and protruding therefrom) is removed before covering the outlet box with cover 15 of the apparatus 10 of the invention. To avoid any confusion between the common coaxial outlet cover or faceplate or wall plate attached to a coaxial outlet box and the faceplate of the cover of the apparatus of the invention, the faceplate component of the cover 15 of the apparatus 10 of the invention is called herein the "frontplate."

The frontplate component 12 and backplate component 14 (or 144) of the invention are made of material that satisfies standards for UL safety certification of outlet covers. Such materials are characterized by resistance to chemicals, heat and impact, and typical applications include use in appliance housings and electronic and electrical assemblies. These materials include various plastics, including acrylonitrile butadiene styrene or ABS and polyvinyl chloride or PVC.

Figure 3:
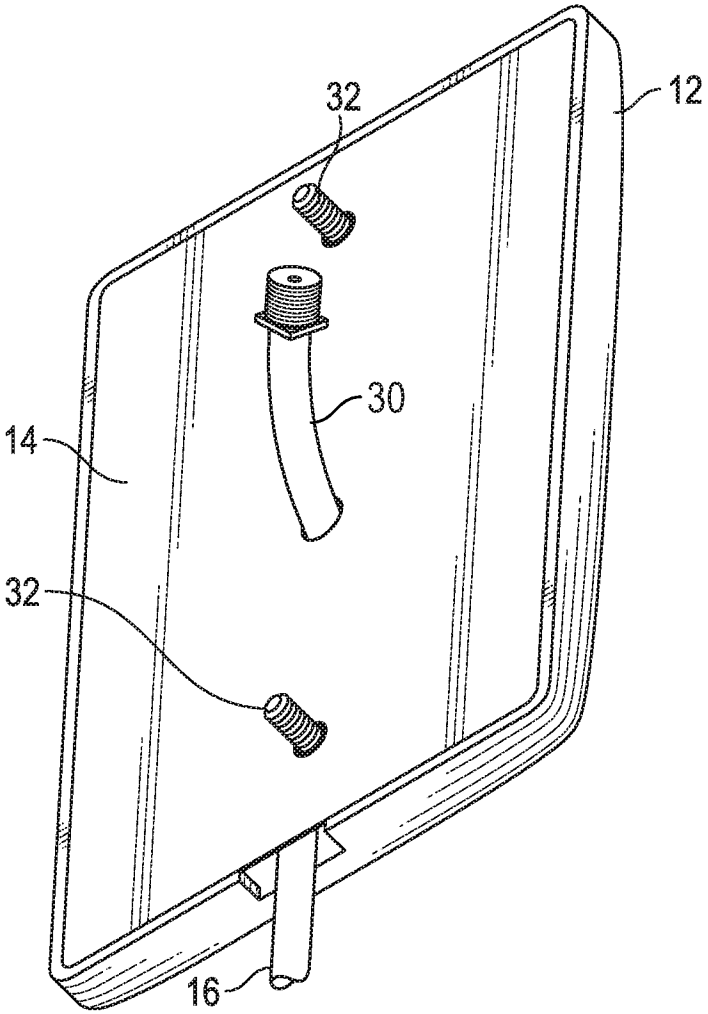
FIG. 3 is a back perspective view of the cover of one embodiment of the apparatus of the invention, wherein the backplate has an opening approximately in the center of the backplate from which the female connection component will extend out of the backplate for connection with the male connection component associated with the coax outlet box.
Figure 6:
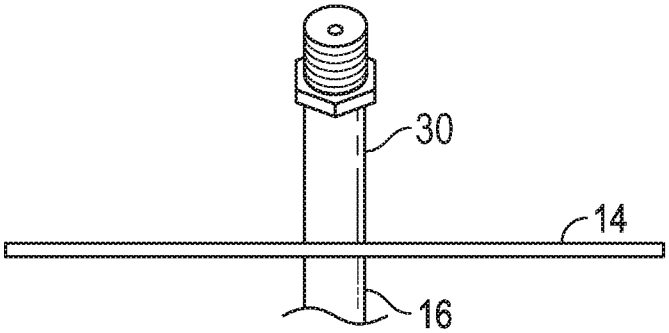
FIG. 6 is a top view of the backplate of the embodiment of the apparatus of FIG. 3 showing the coaxial cable and the coaxial connection component attached at the end thereto as it extends out of the backplate.
Figure 5:
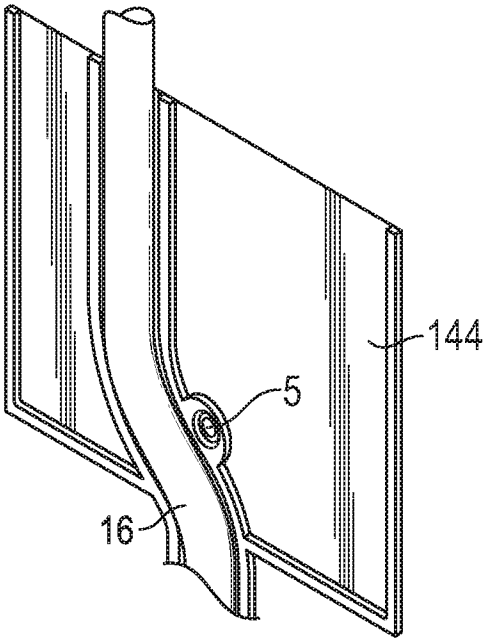
FIG. 5 is a view of the inside of the backplate of the cover of an alternative embodiment of the apparatus of the invention, wherein the backplate is a "halfplate" when compared to the backplate shown in the embodiment in FIG. 3, and showing the channel in which the end of the coaxial cable from which the female connection component extends will be secured as that female connection component extends out of the backplate for connection with the male connection component associated with the coax outlet box.

Referring to FIGS. 3 and 5, the maximum distance between the backplate component 14 (or 144) and the frontplate component 12 is approximately the height or thickness of the coaxial cable 16 connected to or attached to or otherwise associated with the backplate component 14 (or 144), and this distance is only in the main body or central portion of the cover 15, as the outer or perimeter edges of the components 12 and 14 are proximate one another and touch or essentially touch, with the perimeter edge of backplate component 14 (or 144) fitting inside the outer edge of frontplate component 12. The frontplate component 12 is sized to align and position over, and preferably curve slightly around or up to the perimeter edge of, the backplate component 14 (or 144) for a tight fit—preferably tight enough to require no adhesive or screws to hold the components 12 and 14 (or 144) together. In some embodiments such as one shown in part for example in FIG. 5, backplate 144 may fit or snap in place against a portion of the backside of frontplate component 12, leaving the remaining portion of the backside of frontplate component 12 open and laying directly over a corresponding portion of the outlet box 11.

An integral aspect of the apparatus 10 of the invention is that the coaxial cable female connection component 30 at the end of coaxial cable 16 passes through, or out of, the back of cover 15. In this aspect, cover 15 lacks any coaxial cable connection component that commonly protrudes from a typical coaxial wall outlet. The depth of cover 15, measured by the distance between the wall 23, when cover 15 is attached through screws 32 to the underlying coaxial outlet box 11, is less than the depth of a typical (prior art) coaxial outlet box 11 having a coaxial cable connection component 33 and connector extending therefrom and protruding through a wall plate and a typical coaxial cable and connector connected thereto extending several inches outward therefrom. Cover 15 of the invention can have less depth than the depth of baseboard molding 21 at the base of the wall 23.

In other words, a typical coaxial cable connection component and coaxial cable connected to such connection component (as typical in the prior art without the present invention) extend several inches from the coaxial outlet box in a wall, such as coaxial outlet box 11. Such coaxial cable connection component and coaxial cable typically protrude or extend outwardly from the coaxial wall outlet a distance of more than an inch and most often protrude as much as about two inches to even four inches. In contrast, the cover 15 of the apparatus 10 of the present invention, when attached to coaxial outlet box 11, extends outward from the outlet box no more than the thickness of the cover 15. Cover 15 is as thin as the thickness of the combination of the frontplate component 12 mounted on the backplate component 14 (or 144) and coaxial cable 16 in between the components 12 and 14 (or 144). This combined thickness, or thinness, is less than about one half inch and also is less than the thickness of a typical baseboard at the base of a wall in preferred embodiments.

An integral aspect of this embodiment of the invention is connection of the coaxial female connection component 30 to a coaxial male connection component 33 of coaxial outlet box 11 as shown in FIG. 2 of the underlying interior coaxial outlet box 11. The opposite or distal end of the coaxial cable 16 has or comprises one or more coaxial male connection components 26 (as shown in FIG. 1) for connecting with one or more third-party coaxial plugs (not shown) for radio frequency signal or digital data or electrical current transmission. Such third-party electrical plugs are not part of the invention, but rather are associated with various household and personal devices such as televisions, computers and peripheral devices that require such signal or data or electrical current for operation.

Thus the distal end of coaxial cable 16 can be any shape and have a composition of metal and insulation that is useful for containing or providing signal or data or electrical current to coaxial cable receivers or devices, such as, for nonlimiting example, a coaxial cable male connection component 26 as shown in FIG. 1.

Coaxial outlet box 11 can contain or have attached thereto multiple coaxial cable connection components or other types of cords or cables with associated connection components, such as a high-definition multimedia interface (HDMI) cable and associated connection component, a universal serial bus (USB) cable and associated connection component, and/or an ethernet cable and associated connection component. In one embodiment, the apparatus of the present invention contains one coaxial cable 16 having a coaxial cable connection component attached at the proximal end thereto, as shown in FIG. 2. In another embodiment, the apparatus of the present invention contains more cables or cords than coaxial cable 16, with each such cable or cord having a coaxial cable connection component attached at the proximal end of each such cable or cord, and each such cable or cord extending downward from its connection component out of cover 15, either combined together as two cables within a larger cable or cord or as two separate cables positioned together or adjacent one another. In still another embodiment, the apparatus of the present invention contains at least one coaxial cable 16 having a coaxial cable connection component attached at the proximal end of the cable or cord and one or more high-definition multimedia interface (HDMI) cable(s) and associated connection component(s) at the proximal end of each such HDMI cable, where all of the cables extend downward together from their connection components out of the cover 15. In still another embodiment, the apparatus of the present invention contains at least one coaxial cable 16 having a coaxial cable connection component attached at the proximal end of the cable, and one or more universal serial bus (USB) cables having associated connection components at the proximal end of each of those cables, where each such cable extends downward from such connection component out of cover 15. In another alternative embodiment, the apparatus of the present invention contains at least one coaxial cable 16 having a coaxial cable connection component attached at its proximal end, and one or more ethernet cables with each having an associated connection component at its proximal end, and each such cable extending downward from its particular or respective connection component out of cover 15. In still another alternative embodiment, the apparatus of the present invention contains at least one coaxial cable 16 having a coaxial cable connection component attached at the proximal end of that cable and a combination of: one or more high-definition multimedia interface (HDMI) cables, each having an associated connection component at the proximal end of the HDMI cable; one or more universal serial bus (USB) cables, each having an associated connection component at the proximal end of the USB cable; and/or one or more ethernet cables, each having an associated connection component at the proximal end of the ethernet cable, where all of these cables extend downward from their respective connection components out of cover 15.

As stated herein, the "downward" direction of the cables from cover 15 is meant to distinguish or differentiate from a direction that protrudes outwardly from the cover at an approximate ninety degree angle with respect to the wall, and thus the "downward" direction herein may be understood to alternatively be upward, or even sideways, depending on the positioning of the cover and desired direction of the cables, with the direction being generally understood to be approximately adjacent to the wall or extending linearly from cover 15 as shown in the FIGS. 1-4, and generally parallel to the wall, as opposed to a ninety degree direction outwardly from cover 15 and from the wall.

As indicated above, through use of coaxial cable 16 and associated coaxial cable connection component 30, as shown in FIG. 2, the apparatus of the present invention advantageously eliminates the need to attach a coaxial cable through its associated connection component to a coaxial cable connection component or connector protruding or extending from the exterior of a wall plate and connected to a coaxial connection component such as component 33 in the exterior of a coaxial wall outlet 11. Rather, the attachment of coaxial cable connection component 30 to coaxial male connection component 33 of coaxial outlet box 11 is made within coaxial outlet box 11 which is concealed by cover 15 of the apparatus 10 of the invention, particularly when cover 15 is attached to coaxial outlet box 11 by means of screws 32 extending through screw holes 5 of cover 15 to corresponding screw holes 6 of coaxial outlet box 11. Further, in this aspect, the present invention has an aesthetic benefit, with embodiments whereby the coaxial cable connection component (for connecting cables and connection components connecting third party devices) is at the distal end of the coaxial cable 16 (as shown in FIG. 1), over conventional attachment of a coaxial cable connection component (leading to connection with a third party device) directly to the front cover or face of a coaxial wall outlet. Thus, the present invention enables one to effectively "move" the coaxial outlet box to a more preferred location for use without actually having to physically move the coaxial outlet box.

The apparatus of the invention also advantageously can be used with any standard, conventional, or typical indoor coaxial outlet box in a wall, without having to make any adjustments or physical changes in the coaxial outlet box in a wall, other than to remove the existing wall plate or typical faceplate over such outlet box.

Coaxial outlet box 11, as indicated in FIG. 2, is a standard, conventional, or typical indoor coaxial outlet box commonly containing within its interior a single coaxial cable and associated male connection component. Thus, coaxial female plug connector 30 of the apparatus of the invention 10 attaches to such a standard indoor coaxial outlet box 11 having within its interior a single coaxial cable and associated male connection component by attachment to such male connection component and optionally or preferably by fastening screws 32 extending through screw holes 5 of cover 15 of apparatus 10 to corresponding screw holes 6 of an underlying coaxial outlet box 11.

The apparatus of the present invention can also be readily adapted for standard, conventional, or typical coaxial outlet boxes having multiple coaxial cable connection components of a coaxial outlet box of a wall, such as for non-limiting example, double or triple coaxial cable connection components of a coaxial outlet box of a wall. Such outlets tend to simply be double, triple, quadruple, or other multiple versions of a single coaxial cable connection component of a coaxial outlet box of a wall. Thus the apparatus of the invention would be expanded to accommodate two, three or four or other multiple coaxial cable connection components of a coaxial outlet box of a wall.

In such alternative embodiments of the invention not shown, for use with coaxial outlet boxes containing or having attached thereto multiple coaxial cable connection components, the backplate component of the cover of the apparatus of the invention is sized to align and attach to such multiple coaxial cable connection components of a coaxial outlet box of a wall. The frontplate component is sized to attach to and position over and curve slightly around the perimeter edge of the backplate component for a tight fit as described above that preferably requires no adhesive or screws to stay in place. To add to the aesthetics of the cover 15 of the invention, in one embodiment at least the front or exterior of the frontplate is painted or is covered in wallpaper.

The present invention has been illustrated with coaxial cable connection components and coaxial outlet boxes having shapes that are commonly used in the United States of America. However, it is known that different shaped coaxial cable connection components and coaxial outlet boxes are used in different countries and the present invention may readily be adapted for those different shapes.

While preferred embodiments of the present disclosure have been described, it should be understood that other various changes, adaptations and modifications can be made therein without departing from the spirit of the invention(s) and the scope of the appended claims. The scope of the present disclosure should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed.

What is claimed is:

1. An apparatus for hiding a standard indoor wall coaxial cable outlet box positioned in a wall, said coaxial cable outlet box comprising at least two first screw holes, and having any wall plate over said coaxial cable outlet box removed, and said coaxial cable outlet box having within the interior of said coaxial cable outlet box at least one first coaxial cable with an associated first coaxial male connection component, while affording continued use of said first coaxial cable and said first coaxial male connection component within the coaxial cable outlet box when said coaxial cable outlet box is hidden by the apparatus, the apparatus comprising:

a. a cover, mimicking a blank wall outlet cover, comprising:
   (i) a frontplate;
   (ii) a backplate, having an opening, or together with the frontplate forming an opening; and
   (iii) at least two second screw holes which correspond to the said at least two first screw holes of the coaxial cable outlet box, wherein the cover is attached to or held over the coaxial cable outlet box by insertion of screws or other fasteners through said at least two second screw holes into the corresponding said at least first two screw holes of the coaxial cable outlet box; and b. at least one second coaxial cable, having a proximal end and a distal end, and said at least one second coaxial cable having at said proximal end a first female coaxial connection component extending outwardly from said opening in the backplate or said opening formed by the backplate together with the frontplate, and said first female coaxial connection component positioned to correspond and attach to said first coaxial male connection component of said first coaxial cable in said coaxial cable outlet box for connecting said first coaxial cable to said second coaxial cable for continued use of said first coaxial cable when said cover is attached to or held over said coaxial cable outlet box, and said second coaxial cable extending downwardly from the cover such that the cover and said second coaxial cable do not extend outwardly from the wall outlet more than about one-half inch, and with said second coaxial cable's distal end comprising a second male or second female coaxial connection component.

2. The apparatus of claim 1 wherein the first female coaxial connection component of the second coaxial cable exits the central area of the back of the cover for connection to the coaxial male connection component of the coaxial outlet box.

3. The apparatus of claim 1 wherein the backplate fits inside the frontplate and the backplate and the frontplate hold together without fasteners, attachers, or adhesive.

4. The apparatus of claim 1 wherein the frontplate has perimeter edges which curve over the outer edges of the backplate.

5. The apparatus of claim 1 wherein the exterior surface of the frontplate is blank with two apertures or screw holes.

6. The apparatus of claim 1 wherein the distance that the second axial cable extends from the cover is an amount selected from the range of about three feet to about thirty feet.

7. The apparatus of claim 1 wherein the cover is sized to hide a one-gang sized coaxial cable outlet box.

8. The apparatus of claim 1 wherein the cover is sized to hide a two-gang sized coaxial cable outlet box.

9. The apparatus of claim 1 wherein the cover is sized to hide a three-gang sized coaxial cable outlet box.

10. The apparatus of claim 1 wherein the second coaxial cable extending from the cover extends downward from the cover and runs adjacent said wall to a desired location.

11. The apparatus of claim 10 wherein the cover and the second coaxial cable extend outward from the wall a distance no greater than about one-half inch.

12. The apparatus of claim 10 wherein at least a portion of the second coaxial cable extending from the cover is affixed to said wall.

13. An apparatus for hiding a standard indoor wall coaxial cable outlet box positioned in a wall, said coaxial cable outlet box comprising at least two first screw holes, and having any wall plate over said coaxial cable outlet box removed, and said coaxial cable outlet box having within the interior of said coaxial cable outlet box at least one first coaxial cable with an associated first coaxial male connection component and at least one first other type cable selected from the group consisting of high-definition multimedia interface (HDMI) cables, universal serial bus (USB) cables, and ethernet cables, with associated connection components, while affording continued use of said at least one first coaxial cable and said first coaxial male connection component and said at least one first other type cable and associated connection component within said coaxial cable outlet box, the apparatus comprising:

a. a cover, mimicking a blank wall outlet cover, comprising:
   (i) a frontplate; and
   (ii) a backplate, having an opening, or together with the frontplate forming an opening; and
   (iii) at least two second screw holes which correspond to the said at least two first screw holes of the coaxial cable outlet box, wherein the cover is attached to or held over the coaxial cable outlet box by insertion of screws or other fasteners through said at least two second screw holes into the corresponding said at least first two screw holes of the coaxial cable outlet box; and b. a second coaxial cable, having a proximal end and a distal end, and having at said proximal end of said second coaxial cable a female coaxial connection component extending outwardly from said opening in the backplate or said opening formed by the backplate together with the frontplate, and said female coaxial connection component positioned to correspond and attach to the first coaxial male connection component of the coaxial cable in said coaxial cable outlet box for connecting said first coaxial cable to said second coaxial cable for continued use of said first coaxial cable when said cover is attached to or held over said coaxial cable outlet box, and said second coaxial cable extending downwardly from the cover such that the cover and said second coaxial cable do not extend outwardly from the wall outlet more than about one-half inch, and with said second coaxial cable's distal end comprising a second male coaxial connection component; and c. at least one second other type cable selected from the group consisting of high-definition multimedia interface (HDMI) cables, universal serial bus (USB) cables, and ethernet cables, with associated connection components and of like kind with said at least one first other type cable, said at least one second other type cable having a proximal end and a distal end and having at said proximal end a connection component extending outwardly from said opening in the backplate or said opening formed by the backplate together with the frontplate, and positioned to correspond and attach to a respective connection component associated with said at least one first other type cable of like kind, and said second other type cable extending from the backplate, or the cover, such that the cover and said second other type cable do not extend outwardly from the wall outlet more than about one-half inch, and with said second other type cable's distal end comprising a connection component for connecting to third-party devices.

14. An apparatus for hiding a standard indoor wall data transmission cable outlet box positioned in a wall, said data transmission cable outlet box having any wall plate over said data transmission cable outlet outlet box removed, and said data transmission cable outlet box having within the interior of said data transmission cable outlet box at least one first data transmission cable with an associated first data transmission male connection component, while affording continued use of said first data transmission cable and said first data transmission male connection component within the data transmission cable outlet box when said data transmission cable outlet box is hidden by the apparatus, the apparatus comprising:

a. a cover, mimicking a blank wall outlet cover, comprising:

(i) a frontplate;

(ii) a backplate, having an opening, or together with the frontplate forming an opening; and (iii) a fastener for attaching the cover to or holding the cover over the data transmission cable outlet box; and b. at least one second data transmission cable, having a proximal end and a distal end, and said at least one second data transmission cable having at said proximal end a first female data transmission connection component extending outwardly from said opening in the backplate or said opening formed by the backplate together with the frontplate, and said first female data transmission connection component positioned to correspond and attach to said first data transmission male connection component of said first data transmission cable in said data transmission cable outlet box for connecting said first data transmission cable to said second data transmission cable for continued use of said first data transmission cable when said cover is attached to or held over said data transmission cable outlet box, and said second data transmission cable extending downwardly from the cover such that the cover and said second data transmission cable do not extend outwardly from the wall outlet more than about one-half inch, and with said second data transmission cable's distal end comprising a second male or second female data transmission connection component.

15. The apparatus of claim 14 wherein the first and second data transmission cables are selected from the group consisting of HDMI cables, USB cables, and Ethernet cables.

16. An apparatus for hiding a standard indoor wall data transmission cable outlet box positioned in a wall, said data transmission cable outlet box having any wall plate over said data transmission cable outlet outlet box removed, and said data transmission cable outlet box having within the interior of said data transmission cable outlet box at least one first data transmission cable with an associated first data transmission female connection component, while affording continued use of said first data transmission cable and said first data transmission male connection component within the data transmission cable outlet box when said data transmission cable outlet box is hidden by the apparatus, the apparatus comprising:

a. a cover, mimicking a blank wall outlet cover, comprising:

(i) a frontplate;

(ii) a backplate, having an opening, or together with the frontplate forming an opening; and (iii) a fastener for attaching the cover to or holding the cover over the data transmission cable outlet box; and b. at least one second data transmission cable, having a proximal end and a distal end, and said at least one second data transmission cable having at said proximal end a first male data transmission connection component extending outwardly from said opening in the backplate or said opening formed by the backplate together with the frontplate, and said first male data transmission connection component positioned to correspond and attach to said first data transmission female connection component of said first data transmission cable in said data transmission cable outlet box for connecting said first data transmission cable to said second data transmission cable for continued use of said first data transmission cable when said cover is attached to or held over said data transmission cable outlet box, and said second data transmission cable extending downwardly from the cover such that the cover and said second data transmission cable do not extend outwardly from the wall outlet more than about one-half inch, and with said second data transmission cable's distal end comprising a second female or second male data transmission connection component.

17. The apparatus of claim 16 wherein the first and second data transmission cables are selected from the group consisting of coaxial cables, HDMI cables, USB cables, and Ethernet cables.

* * * * *